US005720226A

United States Patent [19]

Padovano

[11] Patent Number: 5,720,226

[45] Date of Patent: Feb. 24, 1998

[54] OBJECT RETAINING DEVICE

[76] Inventor: Diane Gail Padovano, 271 Newman St., Metuchen, N.J. 08840

[21] Appl. No.: 533,080

[22] Filed: Sep. 25, 1995

[51] Int. Cl.[6] ..... A47B 23/00

[52] U.S. Cl. ..... 108/25; 108/26

[58] Field of Search ..... 108/25, 26, 24, 108/161, 42, 50, 44; 206/564, 589, 483

[56] References Cited

U.S. PATENT DOCUMENTS

| | | | |
|---|---|---|---|
| 2,285,576 | 6/1942 | Fox | 108/25 X |
| 2,651,926 | 9/1953 | Enslein | 108/50 X |
| 2,808,191 | 10/1957 | Cramer | 108/26 X |
| 3,062,602 | 11/1962 | O'Brien et al. | 311/26 |
| 3,181,483 | 5/1965 | De Vitt et al. | 108/25 X |
| 3,605,769 | 9/1971 | Bagwell | 108/25 X |
| 3,696,920 | 10/1972 | Lahay | 206/63.2 R |
| 3,744,435 | 7/1973 | Tracy et al. | 108/26 |
| 3,939,976 | 2/1976 | Vanlseghem, Jr. | 108/50 X |
| 4,177,737 | 12/1979 | Brickman | 108/11 |
| 4,448,312 | 5/1984 | Schuman | 108/25 X |
| 4,619,386 | 10/1986 | Richardson | 108/44 X |
| 5,007,539 | 4/1991 | Ruter | 206/589 X |
| 5,085,153 | 2/1992 | McKee | 108/44 |
| 5,134,930 | 8/1992 | Mei-Hwa | 108/42 |
| 5,176,259 | 1/1993 | Andersen | 206/557 |
| 5,334,186 | 8/1994 | Alexander | 604/180 |
| 5,355,811 | 10/1994 | Brewer | 108/43 |
| 5,460,102 | 10/1995 | Pasmanick | 108/25 X |

FOREIGN PATENT DOCUMENTS

| | | | |
|---|---|---|---|
| 2056822 | 5/1972 | Germany | 312/208.1 |

*Primary Examiner*—Peter M. Cuomo
*Assistant Examiner*—Janet M. Wilkens
*Attorney, Agent, or Firm*—Walter J. Tencza, Jr.

[57] ABSTRACT

A retaining member is provided having one or more openings which are adapted to elastically expand and to exert a contraction force to retain a receptacle designed for use in consumption. A substantially rigid retaining member is also provided for receiving objects. The substantially rigid retaining member has a first opening in its top surface and a second opening in its side surface for receiving objects. A tray comprised of a retaining member and a first and a second leg is provided. The first and second legs are attached to the retaining member so that the retaining member can be easily detached, such as by Velcro. A tray comprised of a retaining member, mounting strips, and a tray support is provided. A method is also provided comprising the steps of fixing mounting strips to a tray support, attaching a retaining member to the mounting strips, and inserting an object into an opening of the retaining member.

6 Claims, 5 Drawing Sheets

OBJECT RETAINING DEVICE

FIELD OF THE INVENTION

This invention relates to the field of object retaining devices and trays.

BACKGROUND OF THE INVENTION

Various object retaining and placement devices are known in the art. For example, U.S. patent to McKee, U.S. Pat. No. 5,085,153, issued Feb. 4, 1992, discloses a table top member 10 having a cavity 18, which can include fixedly mounted coasters 28 or holes for receiving beverage cups. The table top member 10 may be comprised of a hard material, such as plywood or rigid plastic. (Mckee, col. 2, lns. 35–40) U.S. Pat. No. 3,696,920 to Lahay, issued Oct. 10, 1972 discloses a block of semi-rigid foam 10 which is used to retain surgical instruments. As an instrument is forced into a channel 11, it causes a widening of a slot 13. (Lahay, FIG. 1, col. 3, lns. 23–38) When the instrument is no longer being forced into the channel, the foam 10 presses against the instrument to hold it in place. Lahay appears to be directed towards a method and apparatus for packing surgical instruments for shipment.

Brickman, U.S. Pat. No. 4,177,737, issued on Dec. 11, 1979, discloses a flexible fabric 10 for a foldable table. The fabric 10 can be made of cotton, leather, or other fabrics. The fabric 10 includes openings 24 which appear to be larger in dimension than their corresponding receptacles. (Brickman, col. 2, lns. 36–43)

SUMMARY OF THE INVENTION

The present invention provides an improved object retaining device. In one embodiment of the invention a retaining member is provided having one or more openings which are adapted to retain a receptacle. The receptacle preferably is designed for use in eating and drinking. The retaining member is preferably elastic and rigid. In one elastic embodiment the retaining member is forced to expand by the insertion of a receptacle and the retaining member exerts a contraction force to retain the receptacle. The receptacles may be, for example, bowls, dishes, or glasses. The retaining member is preferably a lightweight polyethylene foam block having a depth which allows it to retain some objects, such as drinking glasses without gripping or elastically retaining the drinking glasses.

The retaining member is preferably part of a tray which further comprises a first and a second leg. In one embodiment the tray is formed by mounting the retaining member to a cross member. The first and second legs are preferably attached to the cross member. In some embodiments of the present invention handles are provided at substantially opposing sides of a tray or of the retaining member itself. The cross member and the legs may form a tray support. The tray support may have raised portions for preventing the retaining member from sliding.

In one embodiment of the present invention one or more receptacles provided has a dimension which is slightly greater than its corresponding opening in the retaining member. This allows the appropriate receptacle to force its corresponding opening to expand when the receptacle is inserted into the opening. In some embodiments of the present invention some of the openings in the retaining member are designed to be larger than the dimensions of their corresponding receptacle, so that pressure need not be exerted to place a receptacle in its corresponding opening.

In another embodiment of the invention a substantially rigid device having a top surface and a side surface is provided. The top surface of the substantially rigid device has a first opening which is adapted to receive a first object, and the side surface of the substantially rigid device has a second opening which is adapted to receive a second object.

The present invention is especially advantageous for small children. It allows drinking and eating receptacles to be retained in spite of a child's efforts to knock them over. There are many other uses for the present invention including retaining drinking and eating receptacles in a moving vehicle, such as a car, a plane, or a train. The tray embodiments of the present invention are particularly useful in hospitals for the feeding of patients or for at-home rehabilitation situations. The retaining member of one embodiment of the present invention can be designed for and inserted into a cafeteria type tray or fast food restaurant type tray. These trays are basically flat with surrounding lips and usually do not have legs.

DETAILED DESCRIPTION OF THE DRAWINGS

Figure 1:
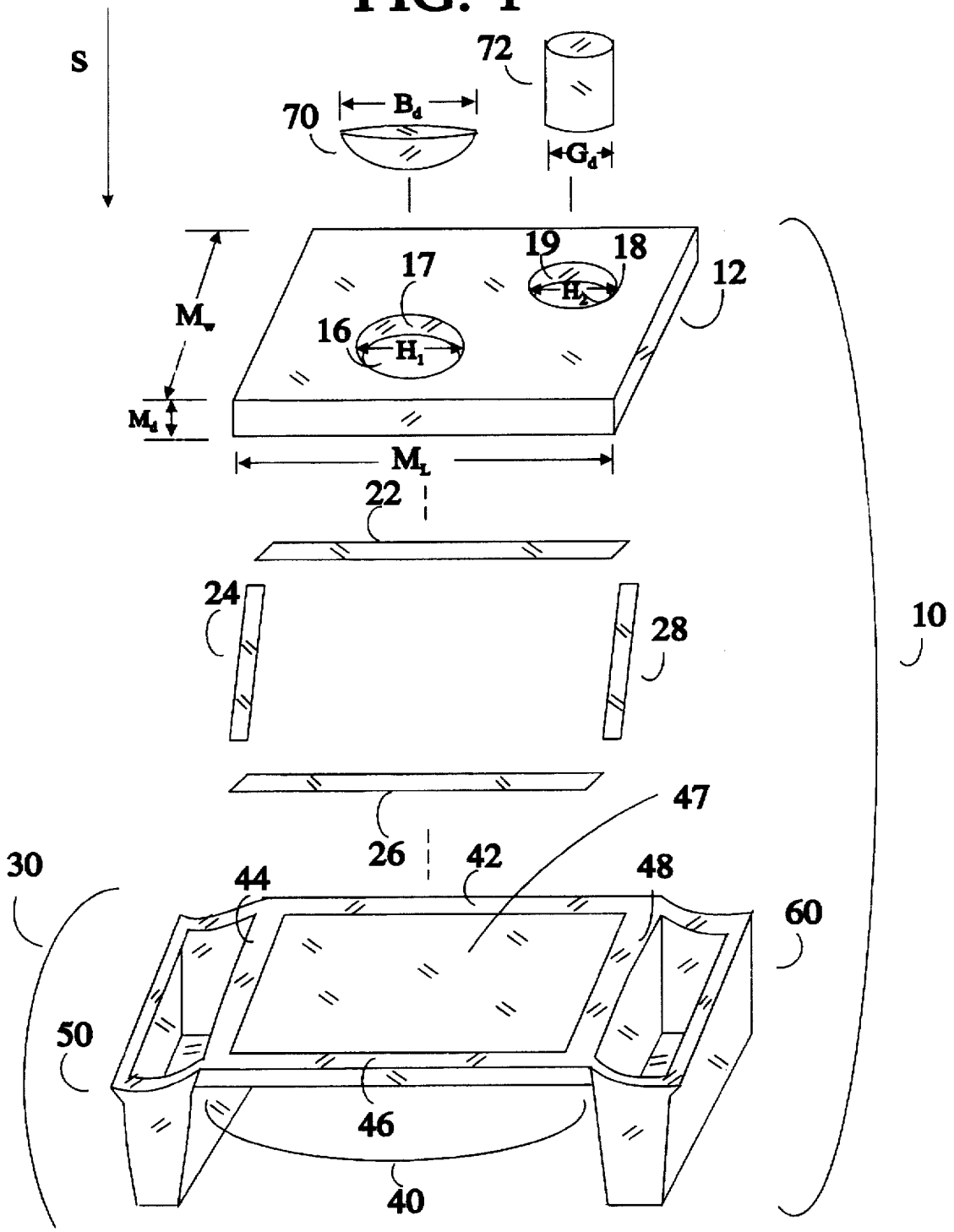
FIG. 1 shows an exploded perspective view of one embodiment of a tray comprised of a retaining member in accordance with the present invention.
Figure 2:
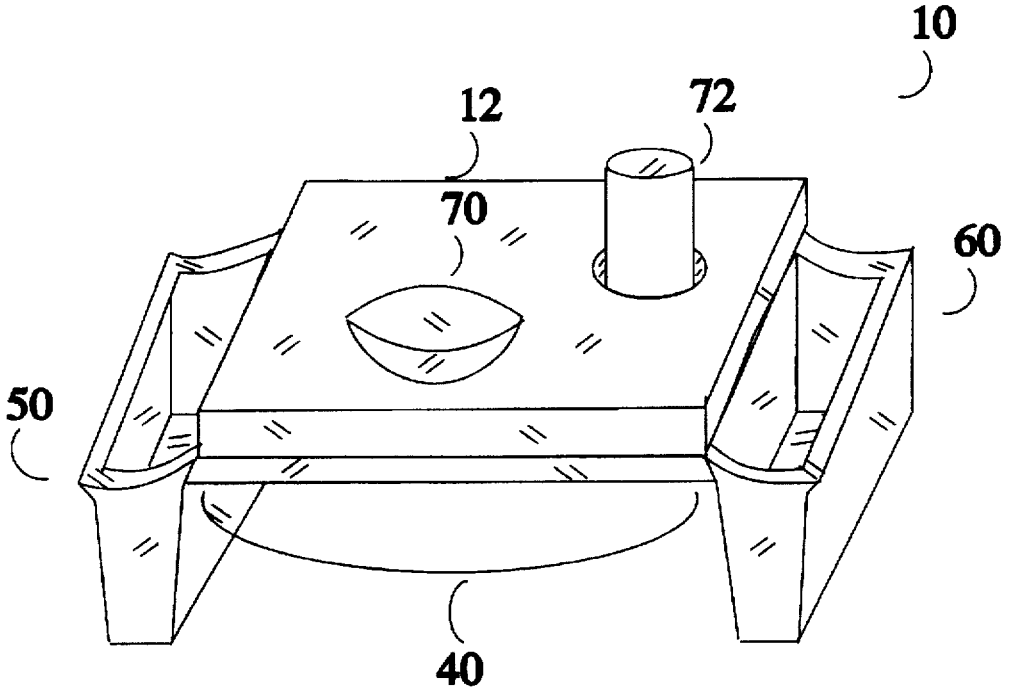
FIG. 2 shows an intact perspective view of the tray embodiment of FIG. 1.

FIGS. 1 and 2 illustrate exploded and intact perspective views of a tray 10, bowl 70, and glass 72 in accordance with an embodiment of the present invention. Tray 10 includes retaining member 12, mounting strips 22, 24, 26, and 28, and tray support 30. Although the retaining member 12 of FIG. 1 will be described with reference to the tray support 30 and mounting strips 22–28, at least one embodiment of the present invention includes the independent use of the retaining member 12.

Retaining member 12 is preferably a rectangular block which may have a length $M_L$ of fifteen inches, a width $M_W$ of twelve inches and a depth "$M_D$" of one and three-quarters inches, although other sizes and shapes are possible. Different densities are possible. These approximate dimensions are particularly appropriate for sitting the retaining member 12 on a person's lap.

The retaining member 12 is preferably both elastic and rigid, although in some embodiments it may be neither. The retaining member 12 can be made out of materials disclosed for the block in U.S. Pat. No. 3,696,920 to Lahay, the contents of which patent are incorporated herein by reference. Preferably, however, the retaining member 12 is made of a recyclable polyethylene or polyethalene foam for reasons to be discussed below. Materials such as elastic and/or rigid rubber, can also be used for the retaining member 12.

The retaining member 12 includes openings 16 and 18. The openings 16 and 18 in the embodiment of FIGS. 1 and 2 are circular holes having diameters $H_1$ and $H_2$, respectively. However, other types of openings having other dimensions are possible. The diameter $H_1$ is preferably slightly less than the diameter, $B_d$, of the bowl 70. This dimension allows the bowl 70 to rest in the opening 16 of the retaining member 12 without falling through. Furthermore, if the retaining member 12 is elastic and if pressure is applied to the bowl 70 when it is resting in the opening 16, in a downward direction "S", as shown in FIG. 1, the bowl 70 will cause the opening 16 to expand. When the opening 16 is forced to expand, the inner surface 17 of the retaining member 12 exerts a counteracting contraction force on the bowl 70. This counteracting contraction force holds the bowl 70 in place.

While other openings can be provided which have diameters less than their intended receptacles, it is preferred that the opening 18 have a diameter $H_2$ which is greater than the diameter $G_d$ of the glass 72. Thus the inner surface 19 does not, preferably, exert a contracting force on the glass 72. This is because the glass 72 needs to be removed easily and may get stuck in the opening 18.

Using a lightweight and yet rigid material, such as polyethylene foam, for the retaining member 12 allows the retaining member 12 to have a large depth "$M_D$" to keep the glass 72 stable without elastically retaining the glass 72, and at the same time is elastic and flexible enough to elastically retain and "grip" the bowl 70. The large depth and the lightweight for retaining member 12 is particularly preferred.

The mounting strips 22–28 are used to attach the retaining member 12 to the tray support 30. The mounting strips 22–28 are preferably flat rectangular strips which have widths and lengths which are determined by the tray support 30. However, the mounting strips 22–28 may be replaced by shorter strips or any other device for mounting. The mounting strips 22–28 are preferably coated with adhesive on the side that will attach to the tray support 30 and with Velcro, which at least at one time was a trademark for and today is the widely known name for a nylon material made with both a surface of tiny hooks and a complementary surface of an adhesive pile, on the side which will attach to the retaining member 12.

Tray support 30 includes cross member 40, and support legs 50 and 60. In the embodiment of FIGS. 1 and 2 the tray support 30 is preferably rigid. Cross member 40 typically comprises raised portions 42, 44, 46, and 48 and an indented rectangular portion 47. The indented rectangular portion 47 is preferably a flat board-like member comprised of smooth top and bottom surfaces. The indented rectangular portion 47 typically prevents the glass 72, or other object provided, from falling through the opening 18. In addition, the rectangular portion 47, in the preferred embodiment, allows the tray 10 to rest comfortably on a person's lap, without the person's knees bumping into glasses, dishes, or other receptacles.

Each raised portion 42, 44, 46, and 48 is preferably rectangularly shaped with a width and a length similar to the width and length of its corresponding mounting strip 22, 24, 26, or 28. It is preferred however that the rectangular edges of the entire apparatus be rounded or smoothed out so as to be safer. The support legs 50 and 60 are typically in the form of hollow buckets. The hollow nature allows the assembled tray 10 to be lightweight while the bucket nature provides a broader surface area for support of the retaining member 12. A device suitable for a tray support 30, called the "Pocket Tray" is manufactured by FREM Corp. which is an Echo Group Co., apparently under the registered trademark "BETTER BY DESIGN". Trays manufactured in accordance with an embodiment of the present invention are preferably stackable. Preferably, the legs 50 and 60 of one tray fit into the bucket portions of the corresponding legs of another tray. In addition, the bucket nature of the support legs 50 and 60 allows the storage of objects or devices, such as containers for food and/or drinks, silverware, or eating containers.

The tray 10 is assembled in the following manner. The mounting strips 22–28 are adhered, such as by gluing, to the corresponding raised rectangular portions 42–48, respectively, on the tray support 30. The retaining member 12 can then be placed on top of the assembled mounting strips 22–28 and tray support 30 as shown in FIG. 2. Velcro typically provided on one side of the mounting strips 22–28 engages the bottom surface of the preferably foam material provided for the retaining member 12 so that the retaining member 12 is temporarily attached to the tray support 30 as shown in FIG. 2. If Velcro is used, the retaining member 12 can also be easily detached from the tray support 30.

Figure 3:
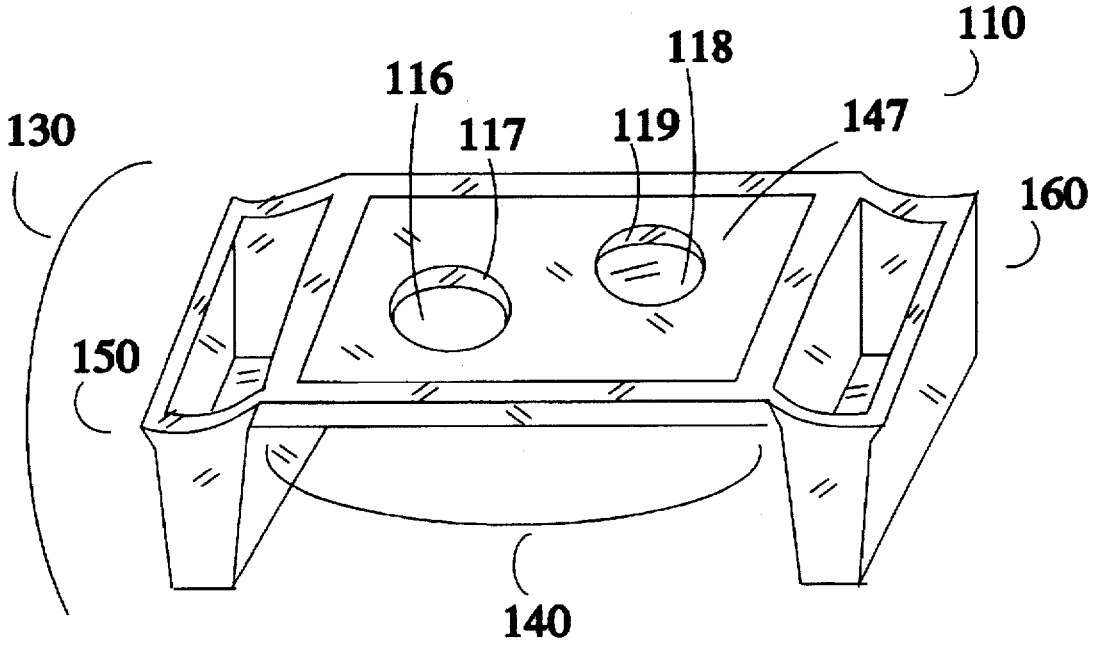
FIG. 3 shows a perspective view of a second embodiment of a tray in accordance with the present invention.

FIG. 3, shows an alternative tray 110 in accordance with an embodiment of the present invention. Unlike tray 10 of FIGS. 1 and 2, a separate retaining member and mounting strips has not been provided. Rather the cross member 140 functions as a retaining member and includes holes 116 and 118 for receiving objects and devices such as eating and drinking receptacles. In this embodiment, at least the opening 118, is preferably closed at one end so that a receptacle such as glass 72 can not fall through the opening 118. In addition this allows rectangular portion 147 to have a smooth bottom surface so that tray 110 can rest comfortably on a persons lap without receptacles bumping into someone's knees.

In the FIG. 3 embodiment the cross member 140 is preferably comprised of a rigid and elastic material so that when an object such as a bowl is forced into the opening 116, opening 116 is expanded by the object. The inner surface 117 of the preferably elastic cross member 140 then exerts a contraction force on the object to prevent the object from falling out. The opening 118 preferably has a larger diameter that its corresponding receptacle, which may be a glass, so that no pressure needs to be exerted. Also shown in FIG. 3 is inner surface 119, support legs 150 and 160, and tray support 130.

Figure 4:
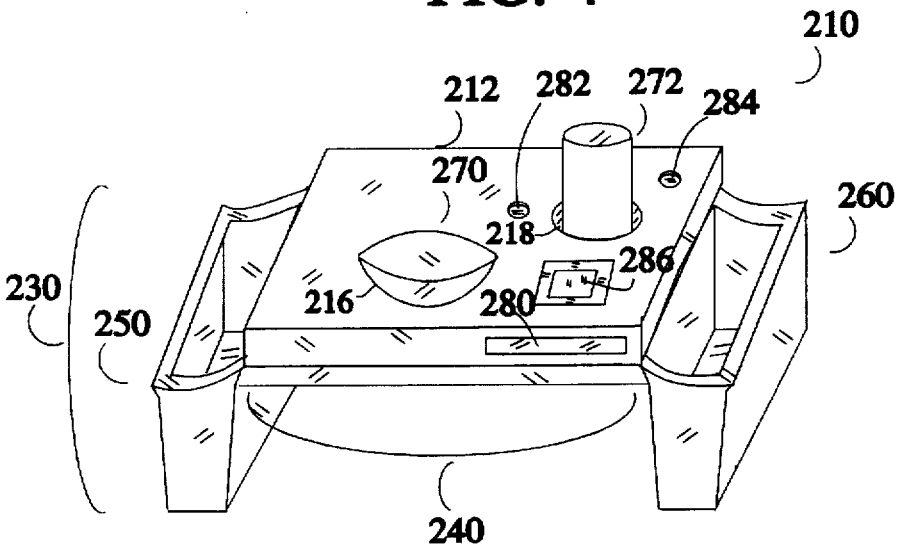
FIG. 4 shows a perspective view of an embodiment of the present invention comprising openings in the top surface and side surface of a retaining member.

FIG. 4 shows a perspective view of a tray 210 in accordance with another embodiment of the present invention. The tray 210 includes a retaining member 212, which is preferably elastic and rigid, mounting strips which are not shown, and a tray support 230. These components are similar to similarly numbered components for tray 10 shown in FIG. 1. The tray support 230 includes cross member 240 and legs 250 and 260. A bowl 270 and a glass 272 are shown inserted into openings 216 and 218 in the top surface of retaining member 212.

In contrast to the embodiment of FIGS. 1 and 2, the tray 210 in FIG. 4 includes an opening 280 in the side surface of the retaining member 212. The opening 280 may be any shape, but is preferably rectangular and typically penetrates deep enough into the retaining member 212 to allow an object such as a menu to be inserted therein. Other substantially rigid devices having openings in the top and side surfaces can be provided instead of retaining member 12. The retaining member 212 also may include further openings 282 and 284 in the top surface of the retaining member 212, each of which may permit crayons or napkins to be inserted therein. An indented portion 286, which can be used for the placement of utensils or other objects, is also provided in the top surface of the retaining member 212.

Figure 5:
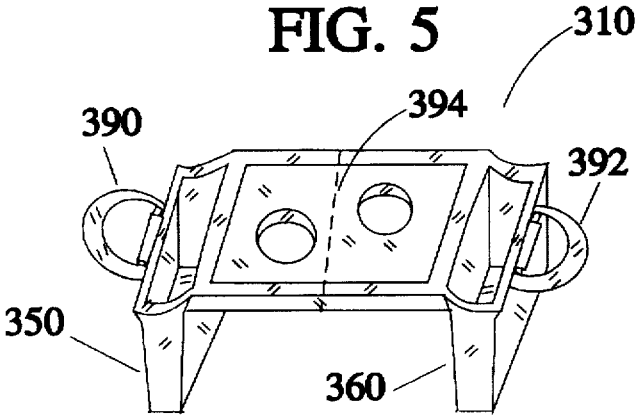
FIGS. 5 and 6 show perspective views of embodiments of the present invention which include handles.
Figure 6:
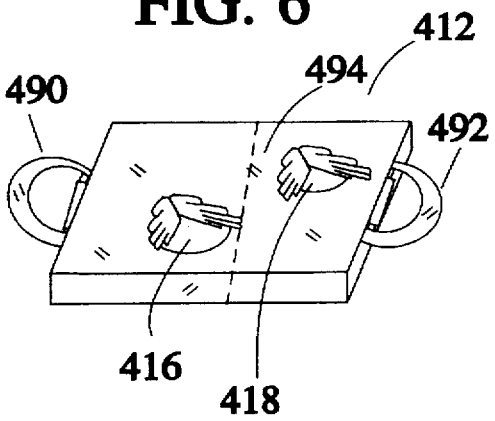
Figure 7:
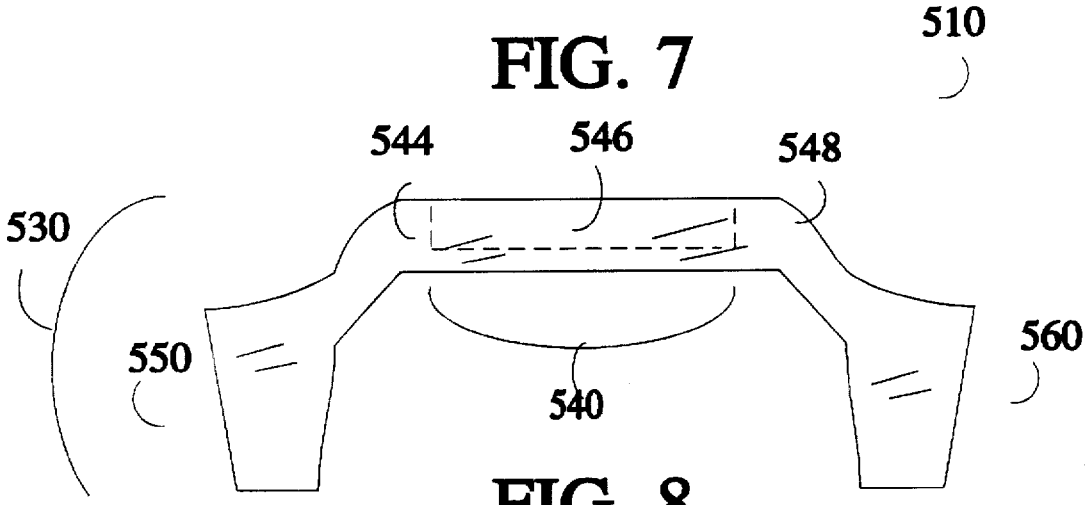
FIGS. 7, 8, 9, and 10 show frontal, un-assembled cross sectional, assembled cross sectional, and perspective views, respectively, of an embodiment of the present invention wherein a retaining member can be inserted within raised portions of a tray support.

FIGS. 5 and 6 show perspective views of embodiments of the present invention which include handles. FIG. 5 shows a tray 310 which is similar to the tray 110 in FIG. 3 which the exception of handles 390 and 392 which are provided at the side of legs 350 and 360. FIG. 6 shows a retaining member 412 similar to the retaining member 12 in FIG. 1. The retaining member 412 includes handles 490 and 492 at its sides. In addition, the openings 416 and 418 which are provided, are preferably partially shaped in the form of two human hands. This provides a user friendly device for children. The openings 416 and 418 can also be shaped in the form of cartoon characters or other objects. FIGS. 5 and 6 show hinges 394 and 494 for folding the tray 310 and the retaining member 412 into more compact units. Other techniques for folding may also be used.

Figure 8:
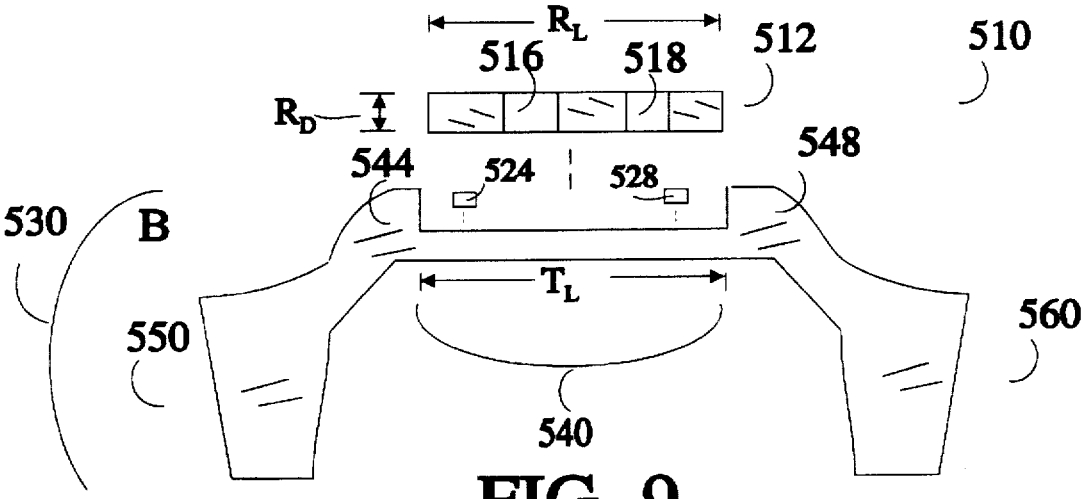
Figure 9:
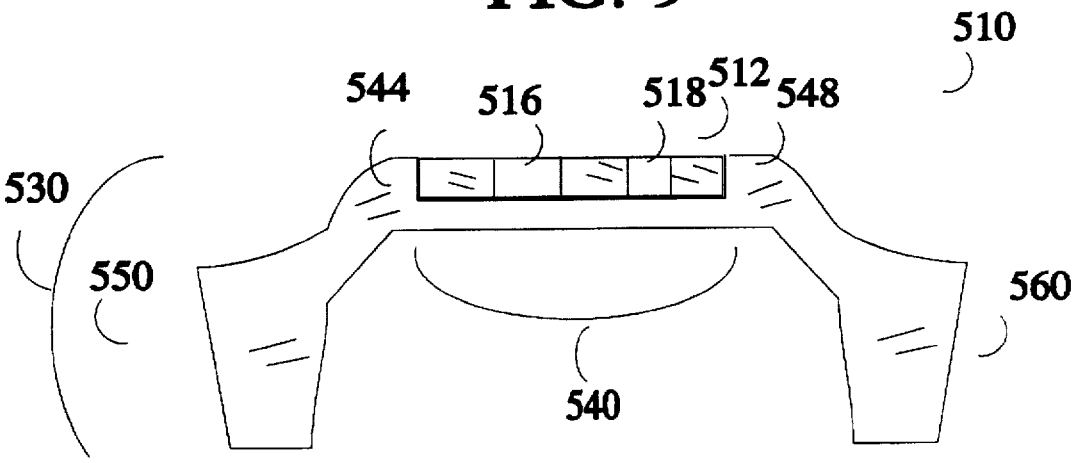
Figure 10:
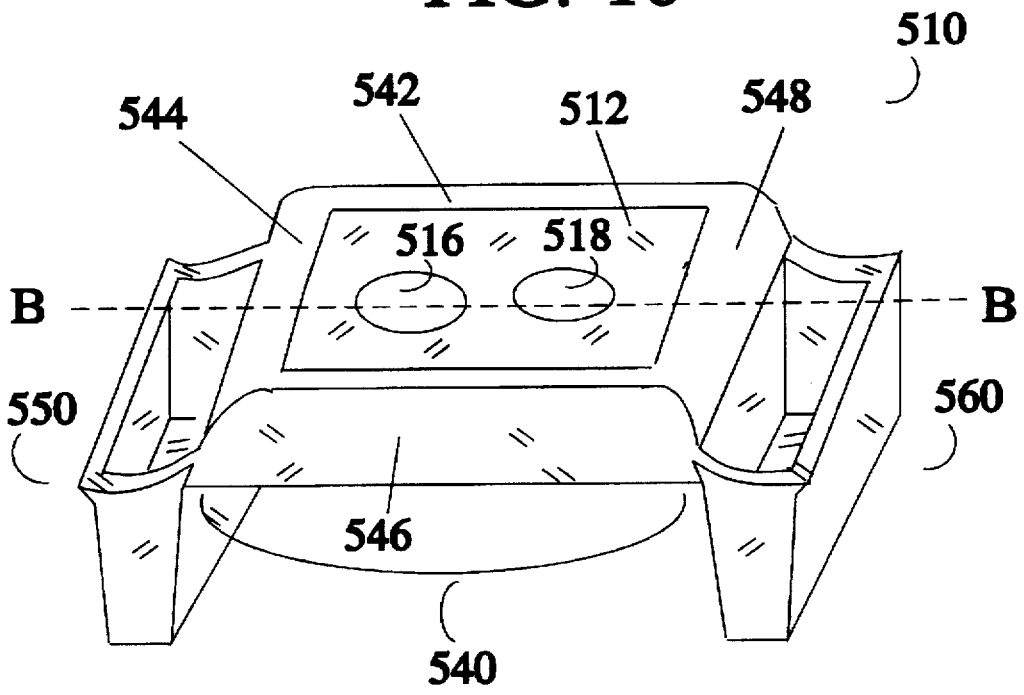

FIGS. 7, 8, 9, and 10 show frontal, un-assembled cross sectional, assembled cross sectional, and perspective views, respectively, of an embodiment of the present invention wherein a retaining member 512 can be inserted within raised portions 544, 546, and 548 (as well as 542 which is shown in FIG. 10) of a tray support 530 to form a tray 510. The cross sectional views are basically views of the tray 510 sliced in half along a line BB running from a leg 550 to a leg 560 as shown in FIG. 10.

The tray 510 includes retaining member 512, mounting pieces 524 and 528 (as well as mounting pieces which are not shown which roughly correspond to mounting strips 26 and 22), and tray support 530. As in the embodiment of FIG. 1, retaining member 512 includes openings, such as 516 and 518 as shown in FIGS. 8, 9, and 10. The tray support 530 includes cross member 540 and legs 550 and 560.

The tray 510 is, for some purposes, the preferred embodiment. The tray 510 is substantially similar to the previous tray 10 shown in FIG. 1 with a few exceptions. Firstly, raised portions 542, 544, 546, and 548, are shaped so that retaining member 512 can fit snugly within raised portions 542, 544, 546, and 548 and so that the retaining member 512 is prevented from sliding.

The retaining member 512 preferably has a length $R_L$ which is slightly less than the length $T_L$, which is the distance between raised portions 544 and 548, and a width which is slightly less than the distance between raised portions 546 and 542. The height of the raised portions 542, 544, 546, and 548 is preferably equal to the thickness $R_D$ of the retaining member 512.

The mounting pieces 524 and 528 (as well as mounting pieces which roughly correspond to mounting strips 26 and 22 which are not shown) are merely shorter versions of the mounting strips 22, 24, 26, and 28 shown in FIG. 1. Because of the support provided by raised portions 542, 544, 546, and 548, the mounting pieces 524, 528, and the mounting pieces which roughly correspond to mounting strips 26 and 22 do not need to contact a large surface area of the retaining member 512. The mounting pieces or the mounting strips 22, 24, 26 or 28 can be placed in any manner to attach a retaining member to a tray support, such as retaining member 512, to the tray support 530. For example, the mounting strips or pieces may be placed under the retaining member 512 and may mount to the surface of the cross member 540. These mounting strips or pieces may be placed closer to the bottom surface center of the retaining member 512 or farther out towards the edges. Alternatively, the mounting strips or pieces may be placed on the sides of the retaining member 512, running along its depth $R_D$ and may attach to the sides of the raised portions 542, 544, 546, and 548.

Figure 11A:
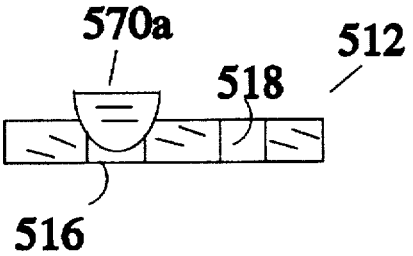
FIGS. 11A, 11B, 12A, 12B, and 12C show cross sectional views of the retaining member of FIG. 7 with eating receptacles of different sizes.
Figure 11B:
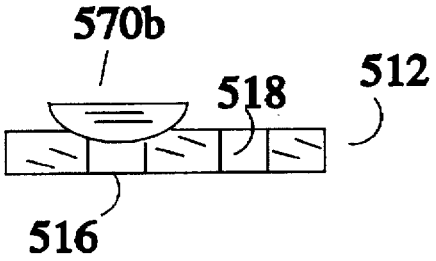

FIGS. 11A and 11B show cross sectional views of the retaining member 512 with a small deep bowl **570*a* and a large shallow bowl 570*b* placed in the opening 516. The diameter of the opening 516 is preferably smaller than the diameter of either bowl 570*a* or 570*b* so that when the bowls are pushed in the retaining member 512 exerts a contracting or gripping force to retain the bowls. As can be seen, the size and the shape of the bowl can vary drastically, but the size opening 516 can typically be used. Both bowls 570*a* and 570*b*** are gripped tightly so that they won't spill.

Figure 12A:
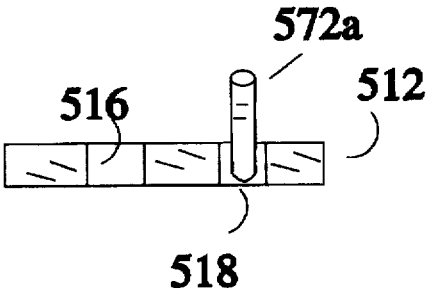
Figure 12B:
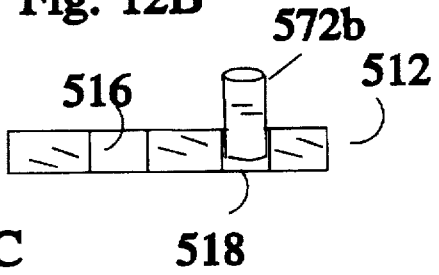
Figure 12C:
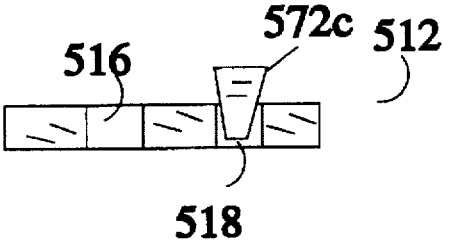

FIGS. 12A, 12B, and 12C show cross sectional views of retaining member 512 with cups of various sizes placed in the opening 518. The diameter of the opening 518 is preferably larger than the cups **572*a*, 572*b*, and 572*c*. As can be seen the cup size can vary drastically, however typically due to the depth and weight of the retaining member 512**, spillage is still prevented.

I claim:

1. An apparatus comprising:

an elastic retaining member having a first opening, which due to the elasticity of the elastic retaining member, expands and contracts to retain a receptacle designed for use in eating or drinking, wherein the elastic retaining member is part of a tray, the tray further comprised of:

a mounting device;

a tray support comprised of a cross member, a first leg and a second leg, each leg attached to the cross member and supporting the cross member, wherein the cross member is further comprised of:

a plurality of raised portions which define a peripheral retaining rim and which surround the elastic retaining member and prevent it from sliding.

2. An apparatus comprising:

a retaining member having a first opening, wherein the retaining member is part of a tray, the tray further comprised of:

a tray support comprised of a cross member, a first leg and a second leg, each leg attached to the cross member and supporting the cross member; and the cross member further comprising a plurality of raised portions which define a peripheral retaining rim and which surround the retaining member and prevent it from sliding and wherein the plurality of raised portions are an integral part of the tray support.

3. The apparatus of claim 2 wherein the retaining member is elastic and due to the elasticity of the retaining member, the first opening expands and contracts to retain a receptacle designed for use in eating or drinking.

4. The apparatus of claim 3 wherein the elastic retaining member is comprised of a substantially rigid foam block.

5. The apparatus of claim 2 wherein the retaining member is comprised of a substantially rigid foam block.

6. The apparatus of claim 5 wherein the cross member is comprised of four raised portions which surround the substantially rigid foam block, one raised portion corresponding to each side of the substantially rigid foam block.

* * * * *